United States Patent [19]

Brouse et al.

[11] Patent Number: 4,817,519

[45] Date of Patent: Apr. 4, 1989

[54] WIRE FEED AND TENSIONING APPARATUS

[75] Inventors: S. Bernard Brouse, Orland Park; John Wiedel, Chicago, both of Ill.

[73] Assignee: Stanwich Holdings, Inc.

[21] Appl. No.: 917,584

[22] Filed: Oct. 10, 1986

[51] Int. Cl.[4] ..... B65B 13/04

[52] U.S. Cl. ..... 100/32

[58] Field of Search ..... 100/26, 29, 32, 30

[56] References Cited

U.S. PATENT DOCUMENTS

| | | | |
|---|---|---|---|
| 3,272,113 | 9/1966 | Otto . | |
| 3,274,921 | 9/1966 | Hall . | |
| 3,295,436 | 1/1967 | Brouse et al. . | |
| 3,447,448 | 6/1969 | Pasic . | |
| 3,590,729 | 7/1971 | Plattner | 100/32 |
| 3,884,139 | 5/1975 | Pasic . | |
| 4,177,724 | 12/1979 | Johnson, III et al. | 100/26 |
| 4,328,742 | 5/1982 | Discavage | 100/32 |

FOREIGN PATENT DOCUMENTS

| | | | |
|---|---|---|---|
| 753716 | 8/1980 | U.S.S.R. | 100/32 |

*Primary Examiner*—Andrew M. Falik

*Attorney, Agent, or Firm*—Welsh & Katz, Ltd.

[57] ABSTRACT

A feed and tensioning apparatus for wire strapping material includes a pair of wheels each having a smooth surfaced peripheral groove for contact with the wire. One of the wheels is rotatively mounted on an axis displaced from its central axis at an angle within the range of 5° to 40° on the exit side of the wheel with respect to the direction of travel of the wire during tensioning.

6 Claims, 3 Drawing Sheets

WIRE FEED AND TENSIONING APPARATUS

TECHNICAL FIELD

This invention relates to feed and tension mechanisms for use with machines that apply strapping material around an article or group of articles, and particularly to an improved feed and tension mechanism for wire strapping machines.

BACKGROUND ART

Feed and tension mechanisms for wire strapping machine commonly have two wheels of differing size each having a smooth surfaced peripheral groove for contact with opposite sides of the wire. Generally, the smaller wheel is driven and the larger wheel is geared to the smaller one by external teeth on the wheels. The larger wheel is usually mounted on an eccentrically located bearing shaft displaced from the axis of the wheel in the lower 90° quadrant on the entry side of the wheel with respect to the direction in which the wire is tensioned just before tying, i.e. the reverse direction opposite from that in which the wire is fed into a loop track around the article. A spring pressed lever attached to the hub of the large wheel biases the larger wheel toward the smaller wheel so as to create a force moment about the eccentric axis of the large wheel. In this design, in order to obtain sufficient friction for tensioning, it is required that the wire be guided along a full 90° quadrant of the groove in the outer periphery of the large wheel. This requirement limits the available locations at which the feed and tension mechanism can be placed in equipment of this design. Examples of such mechanisms are shown in U.S. Pat. Nos. 3,447,448; 3,295,436; 3,274,921; and 3,884,139. On the other hand, a feed and tension mechanism for flat strapping which does not require guiding the strap around a 90° quadrant of the feed wheel is shown in U.S. Pat. No. 3,272,113. In this latter patent, two wheels of the same diameter are provided, one of which is eccentrically mounted in an upper portion of the lower 90° quadrant on an exit side of the wheel with respect to the direction of tensioning. A spring pressed lever attached to the hub of the eccentrically mounted wheel biases this wheel toward the other wheel creating a force moment about the eccentric axis thereof. In this reference, only the eccentrically mounted wheel is driven which is accomplished by a complex set of gears located internally within the driven wheel. Both wheels have peripheral teeth for digging into the surface of the flat strapping in order to obtain sufficient friction for tensioning. Such wheels cannot be used on wire material because the teeth dig into the surface creating defects which are destructive to the twist knots made to secure the wire around the article. The twist knots made in the wire are distinguishable from the sealed or punched fastenings made in flat strapping materials where scratch-type defects are not harmful.

It is therefore a primary object of this invention to provide a feed and tension mechanism for wire strapping machines which does not require guiding the wire over a 90° quadrant of a feed and tension wheel and in which the feed and tension wheels have smooth surface peripheral grooves so as not to damage the wire.

DISCLOSURE OF THE INVENTION

An improvement is provided in a conventional mechanism for feeding metal wire in a first direction around the periphery of an article and tensioning the wire in a second direction opposite to the first direction. The conventional apparatus includes first and second wheels each having a peripheral groove adapted to contact essentially one-half the cross section of the wire on opposed sides of the wire at substantially the same location along the length thereof. Means is provided for rotatively driving the first and second wheel alternately in said first and second directions for feeding and tensioning of the wire, respectively around the article.

The improvement of this invention is characterized by said wire being guided in a substantially straight line path tangent to the groove in the outer periphery of the first and second wheels. The first wheel is mounted on an eccentric axis of rotation, said axis being located in a 90° quadrant on the exit side of the first wheel with respect to the second or tensioning direction. It has been found that the eccentric axis of rotation of said first wheel should be located within said 90° quadrant just mentioned along a radial direction of said first wheel which makes an angle within the range of 5° to 40° with respect to a direction through the central axis of the first and second wheels and normal to said wire. The second wheel is rotatably mounted on a central axis. In this arrangement, increasing torque on the outer periphery of the first wheel increases the pressure exerted by the first wheel on the wire during tensioning without deforming, causing ovalling or otherwise damaging the wire.

MODES FOR CARRYING OUT THE INVENTION

Figure 1:
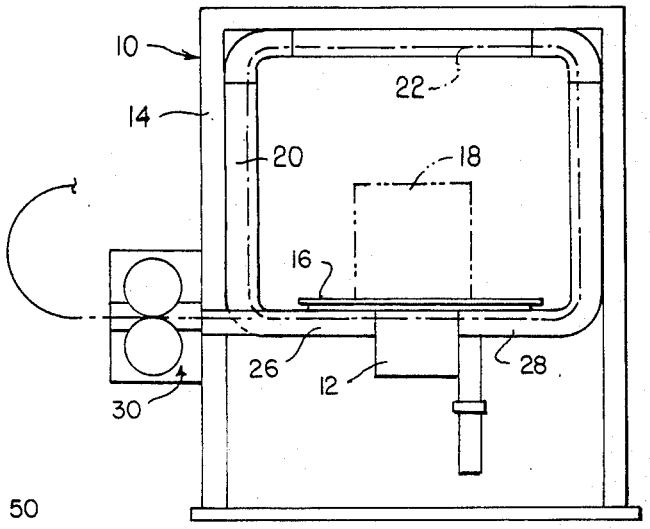
FIG. 1 is a schematic illustration of the arrangement of the apparatus of this invention in a conventional wire strapping unit.

Referring to FIG. 1, an automatic wire strapping machine 10 is provided with a gantry frame 14 having a table 16 disposed therein. Frame 14 and table 16 define a strapping station for applying wire strapping material to a package or article 18. Frame 14 supports guide track 20 around which a metal wire 22 is directed by an improved feed and tension mechanism 30 to be described below. A knotter unit 12 such as that described in U.S. Pat. No. 4,577,544 is disposed beneath table 16, preferably in the lower center region of gantry frame 14. Left and right guide blocks 26 and 28 are provided on either side of knotter unit 12 for guiding wire 22 around guide track 20. General overall operation of the apparatus may be summarized as follows: Wire 22 is fed from a source not shown through the strapping machine 10 by feed and tension mechanism 30. The wire passes through left guide block 26, knotter unit 12, right guide block 28 and around guide track 20. The leading end portion of wire 22 is then fed again through left guide block 26 and knotter unit 12 adjacent to and directly above the portion of the wire remaining therein. The leading end portion of wire 22 is then stopped and retained by a wire gripping means located in the right side of the knotter unit as viewed in FIG. 1. Feeding of the wire is stopped by means of a switch which is actuated by contact of the wire with the gripper means. The motor of the feed and tension mechanism 30 is then automatically reversed so as to pull wire 22 in the reverse direction, stripping the wire from guide track 20 and guide blocks 26 and 28 and tensioning the wire tightly against package or article 18. The knotter unit 12 is actuated to twist a knot in the wire and subsequently cut the wire and eject the knot from the knotter unit.

Figure 3:
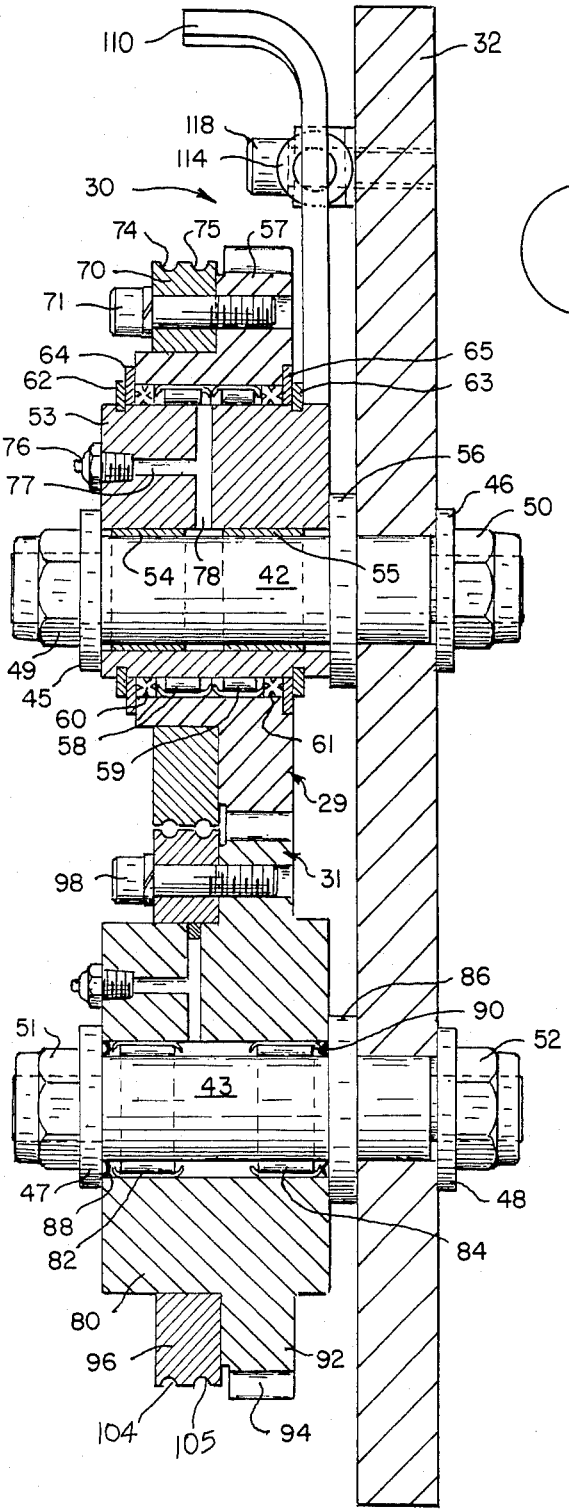
FIG. 3 is a section shown partly in elevation taken along the lines III—III of FIG. 2.
Figure 2:
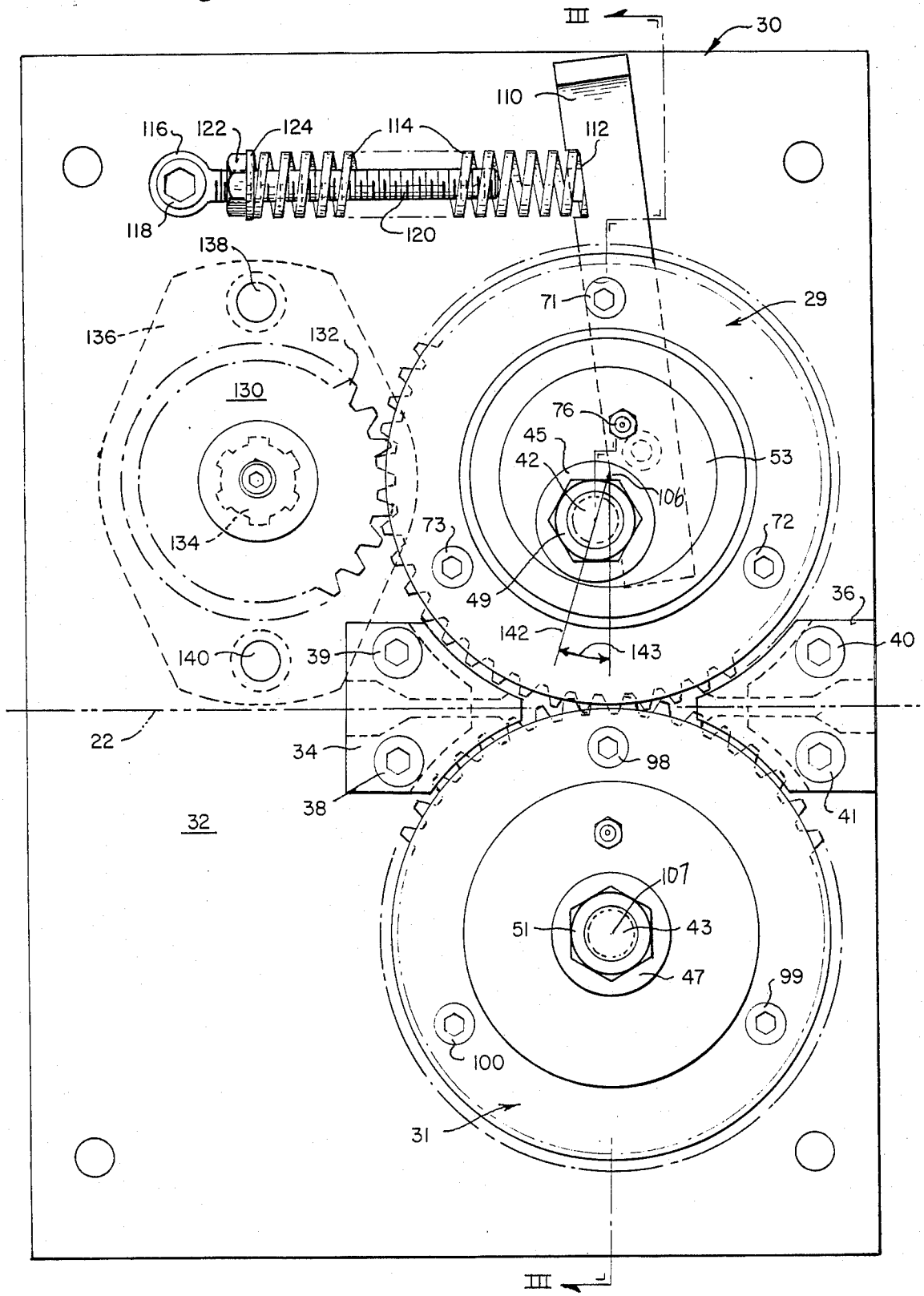
FIG. 2 is a front elevation view of the apparatus of this invention.

Referring now to FIG. 2, feed and tension mechanism 30 includes a mounted plate adapted to be secured to frame 14 at the location illustrated in FIG. 1. Conventional entry and exit guides 34 and 36 are attached to mounted plate 32 by bolts 38, 39, 40 and 41. The guides are located so as to direct the wire from the source into left guide block 26, knotter unit 12 and right guide block 28. First and second wheels 29 and 31 are rotatably mounted on spindles 42 and 43, respectively, which are secured to mounting plate 32 by washers 45, 46, 47 and 48 and nuts 49, 50, 51 and 52 (FIGS. 2 and 3). First wheel 29 has a hub 53 mounted on metal bushing sleeves 54 and 55 on spindle 42. Flange 56 on spindle 42 serves to separate the hub from mounting plate 32 and guide rotative movement of the first wheel 29. A gear ring 57 is rotatably mounted on hub 53 on roller bearing sleeves 58 and 59. Seals 60 and 61 are provided to retain lubricant in the roller bearing sleeves 58 and 59. It is not essential that seals be provided at this location. An airspace may be left here if the seals are omitted. Split ring clamps 62 and 63 engaged in spaced grooves on hub 53 along with washer 64 and 65 secure gear ring 57 on the hub. A wire guide ring 70 is secured to gear ring 57 by three countersunk hex head screws 71, 72 and 73 (FIG. 3). Wire guide ring 70 has a pair of essentially semi-circular annular grooves 74 and 75 for contact with the wire (not shown). The grooves may also be of straight line V-shape construction. Normally wire passes through groove 75 and when that groove becomes worn the wire guide ring may be removed, reversed and reattached so that the wire will then pass through groove 74. A grease fitting 76 is provided for supply of lubricant to passages 77 and 78 in first wheel 29.

Similarly, second wheel 31 has a hub 80 mounted on roller bearing sleeves 82 and 84 located on spindle 43 between an integral flange 86 thereof and washer 47. Seals 88 and 90 are provided to retain lubricant in the roller bearing sleeves 82 and 84. Again, it is not essential that seals be provided at this location and the space for them may be left open. Hub 80 has an integral flange 92 with peripheral gear teeth 94 engaged with the teeth of gear ring 57 of the first wheel, so that first and second wheels 29 and 31 are geared together. A wire guide ring 96 is attached to flange 92 of hub 80 by three countersunk hex head screws 98, 99 and 100 (FIG. 2). Grease fitting and lubricant passages similar to those provided in first wheel 29 are also provided in second wheel 31. Second wheel 31 has a pair of grooves 104 and 105 substantially the same as grooves 74 and 75 in the first wheel.

Figure 4:
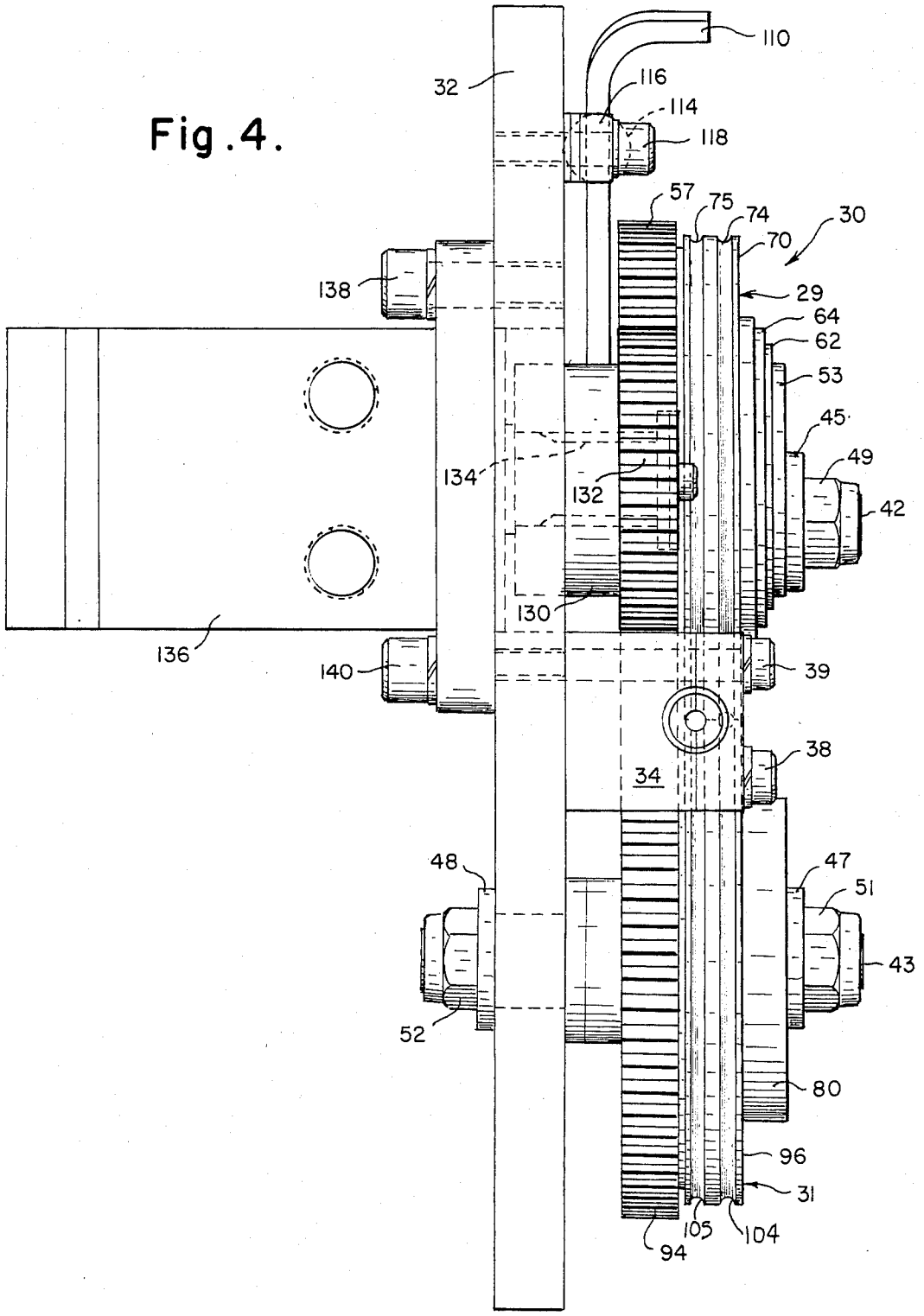
FIG. 4 is an end view of the apparatus shown in FIG. 2.

Lever 110 is bolted to hub 53 of first wheel 29 and has a recess 112 for receiving one end of compression spring 114 therein. Spring 114 urges lever 110 to the right in FIG. 2 so as to press first wheel 29 downwardly against the wire between wheels 29 and 31. Spring 114 provides all the compressive force exerted on the wire during feeding and also on the initial stage of wire tensioning. Bracket 116 attached to mounting plate 32 by screw 118 has an integral rod 120 extending inwardly within a portion of the length of spring 114. A nut 122 is mounted on a threded portion of rod 120 and bears against washer 124 which in turn bears against spring 114. Adjustment of nut 122 will vary the amount of compression of spring 114 and the force exerted on the wire. For soft, fine wire the spring force may need to be reduced to prevent deformation of the wire to an oval shape as described below. Gear wheel 130 has peripheral teeth 132 engaged with the teeth of gear ring 57 on first wheel 29. Gear wheel 130 is mounted on splined shaft 134 of hydraulic motor 136. Motor 136 (FIG. 4) is attached to the back side mounting plate 32 by a pair of screws 138 and 140.

According to the improvement of this invention, entry and exit guides 34 and 36 are aligned so as to direct the wire in a straight line direction tangent to the outer periphery of first and second wheels 29 and 31. Spindle 42 is located in a lower left 90° quadrant of first wheel 29 as viewed in FIG. 2. The axis of spindle 42 is located in a direction 142 making an angle 143 within the range of 5 to 40 degrees, preferably 10 to 30 degrees with respect to a directional line which is both normal to the wire passing through both wheels and which also passes through the central axes of said wheels. Said axes are indicated respectively by the reference numerals 106 and 107 in FIG. 2. The axis of spindle 42 in the most preferred embodiment illustrated is located in a direction making an angle of about 18 degrees with respect to said direction normal to the wire. As mentioned above, spring 114 is designed to provide sufficient clamping force on the wire through first wheel 29 so as to prevent skidding or slipping of first wheel 29 on the wire. As first wheel 29 is rotatively driven in the tensioning direction, an additional clamping action is produced downwardly (as viewed in FIG. 2) through the center of first wheel 29 in the form of torque about the axis of spindle 42. At angles less than 5 degrees and greater than 40 degrees, the wheels will tend to slip and this "additional" clamping force will not be exerted on the wire. As was also described above, adjustment of nut 122 may be required to vary the force exerted by spring 114 even with spindle 42 aligned at angles within the desired range, in order to prevent ovalling, for example on soft, fine wire. In the preferred embodiment, lever 110 extends longitudinally in a direction making an angle of about 7 degrees with the direction normal to said wire in the lower right hand 90° quadrant of first wheel 29 as viewed in FIG. 2. The angle at which lever 110 is located may vary over a rather wide range while still creating a force moment directed around the axis of spindle 42 through the lower right hand 90° quadrant of first wheel 29 as viewed in FIG. 2.

In operation, wire is inserted manually into entry guide 34 between first and second wheels 29 and 31 and into exit guide 39. Motor 136 is actuated to feed the wire forwardly into left guide block 26, knotter unit 12, right guide block 28 and then around guide track 20 and back into left guide block 26 and knotter unit 12 until being stopped by gripping means as previously mentioned. Motor 136 then goes automatically into a reverse mode to pull the wire in the reverse direction stripping it from the guide track and tensioning it around the package or article 18. The first wheel 29 of the feed and tension mechanism of this invention applies increasing compressive force on the wire against second wheel 31 in proportion to torque applied to the wheel by motor 136. Thus, increasing compressive force is applied creating sufficient friction between the first and second wheels and the wire to obtain the necessary tension in the wire for wrapping it tightly around article 18.

We claim:

1. In an apparatus for feeding metal wire in a first direction around the periphery of an article and tensioning said wire in a second direction opposite to said first direction, said apparatus including first and second wheels each having a peripheral groove adapted to contact the wire on opposed sides of the wire at substantially the same location along the length thereof, and means for rotatively driving said first and second wheels alternately in the first and second directions for feeding and tensioning of the wire, respectively, around said article, the improvement in said apparatus which is characterized by:

said wire being guided in a substantially straight line path tangent to the outer periphery of said first and second wheels for contact with the groove in each of said first and second wheels, said axis of rotation of the first wheel being located at an eccentric position in a 90° quadrant on the exit side of said first wheel with respect to said second, tensioning direction, said eccentric axis being located in a direction extending radially from a cental axis of said first wheel, said radial direction making an angle within the range of 5 to 40° with respect to a line passing through the central axis of said first and second wheels, whereby, increasing torque on the outer periphery of said first wheel increases the pressure exerted by said first wheel on the wire during tensioning.

2. The improved apparatus of claim 1 wherein said eccentric axis of rotation of the first wheel is located in a direction making an angle within the range of 10° to 30° with respect to said line passing through the central axes of said first and second wheels.

3. The improved apparatus of claim 1 wherein said first wheel has external peripheral gear teeth displaced laterally from said groove which contacts the wire, and wherein said drive means engages the teeth on the outer periphery of said first wheel for rotatively driving said first wheel.

4. The improved apparatus of claim 3 wherein said drive means includes gear means engaging the teeth on the outer periphery of said first wheel for rotatively driving said first wheel.

5. The improved apparatus of claim 4 wherein said second wheel has external peripheral gear teeth displaced laterally from said groove therein, and wherein the peripheral gear teeth on said second wheel engage those on said first wheel so that said first and second wheels are driven together.

6. The improved apparatus of claim 5 wherein said drive means includes gear means separate from said second wheel engaging the teeth on the outer periphery of said first wheel.

* * * * *